US007188692B2

(12) United States Patent
Lund et al.

(10) Patent No.: US 7,188,692 B2
(45) **Date of Patent: *Mar. 13, 2007**

(54) SUPERABRASIVE CUTTING ELEMENTS HAVING ENHANCED DURABILITY, METHOD OF PRODUCING SAME, AND DRILL BITS SO EQUIPPED

(75) Inventors: Jeffrey B. Lund, The Woodlands, TX (US); Danny E. Scott, Montgomery, TX (US); Marcus R. Skeem, Orem, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/204,289

(22) Filed: Aug. 15, 2005

(65) Prior Publication Data

US 2006/0016626 A1 Jan. 26, 2006

Related U.S. Application Data

(63) Continuation of application No. 10/373,160, filed on Feb. 24, 2003, now Pat. No. 6,935,444.

(51) Int. Cl.
*E21B 10/36* (2006.01)

(52) U.S. Cl. ..... 175/426; 175/431; 175/434

(58) Field of Classification Search ..... 175/426, 175/428, 431, 432, 434
See application file for complete search history.

(56) References Cited

U.S. PATENT DOCUMENTS

| | | | | |
|---|---|---|---|---|
| 4,109,737 | A | 8/1978 | Bovenkerk | |
| RE32,036 | E | 11/1985 | Dennis | |
| 4,558,753 | A | 12/1985 | Barr | |
| 4,592,433 | A | 6/1986 | Dennis | |
| 4,607,711 | A | 8/1986 | Zijsling | |
| 4,682,663 | A | 7/1987 | Daly et al. | |
| 4,792,001 | A | 12/1988 | Zijsling | |
| 4,858,707 | A | 8/1989 | Jones et al. | |
| 4,987,800 | A | 1/1991 | Gasan et al. | |
| 5,016,718 | A | 5/1991 | Tandberg | |
| 5,131,481 | A | 7/1992 | Smith | |
| 5,437,343 | A | 8/1995 | Cooley et al. | |
| 5,706,906 | A | 1/1998 | Jurewicz et al. | |
| 5,967,250 | A | 10/1999 | Lund et al. | |
| 6,000,483 | A | 12/1999 | Jurewicz et al. | |
| 6,050,354 | A | 4/2000 | Pessier et al. | |
| 6,672,406 | B2 | 1/2004 | Beuershausen | |
| 6,935,444 | B2 * | 8/2005 | Lund et al. | 175/426 |

FOREIGN PATENT DOCUMENTS

| | | | |
|---|---|---|---|
| GB | 2 193 740 | A | 2/1988 |

OTHER PUBLICATIONS

IBM Technical Disclosure Bulletin, vol. 13, No. 11, Apr. 1971, 2 pages.

* cited by examiner

*Primary Examiner*—William Neuder
(74) *Attorney, Agent, or Firm*—TraskBritt

(57) ABSTRACT

A superabrasive cutting element including a diamond or other superabrasive material table having a peripheral cutting edge defined by at least two adjacent chamfers having an arcuate surface substantially tangent to each of the at least two chamfers interposed therebetween. Methods of producing such superabrasive cutting elements and drill bits equipped with such superabrasive cutting elements are also disclosed.

34 Claims, 1 Drawing Sheet

SUPERABRASIVE CUTTING ELEMENTS HAVING ENHANCED DURABILITY, METHOD OF PRODUCING SAME, AND DRILL BITS SO EQUIPPED

CROSS-REFERENCE TO RELATED APPLICATION

This application is a continuation of application Ser. No. 10/373,160, filed Feb. 24, 2003, now U.S. Pat. No. 6,935, 444, issued Aug. 30, 2005.

BACKGROUND OF THE INVENTION

1. Field of the Invention

The present invention relates generally to cutting elements of the type employing a table of superabrasive material having a peripheral cutting edge and used for drill bits for subterranean drilling, and specifically to modifications to the geometry of the peripheral cutting edge.

2. State of the Art

Superabrasive cutting elements in the form of Polycrystalline Diamond Compact (PDC) structures have been commercially available for approximately three decades, and planar PDC cutting elements for a period in excess of twenty years. The latter type of PDC cutting elements commonly comprises a thin, substantially circular disc (although other configurations are available), commonly termed a "table," including a layer of superabrasive material formed of diamond crystals mutually bonded under ultrahigh temperatures and pressures and defining a substantially planar front cutting face, a rear face and a peripheral or circumferential edge, at least a portion of which is employed as a cutting edge to cut the subterranean formation being drilled by a drill bit on which the PDC cutting element is mounted. PDC cutting elements are generally bonded over their rear face during formation of the superabrasive table to a backing layer or substrate formed of tungsten carbide, although self-supporting PDC cutting elements are also known, particularly those stable at higher temperatures, which are known as Thermally Stable Products, or "TSPs."

Either type of PDC cutting element is generally fixedly mounted to a rotary drill bit, generally referred to as a drag bit, which cuts the formation substantially in a shearing action through rotation of the bit and application of drill string weight thereto. A plurality of either, or even both, types of PDC cutting elements is mounted on a given bit, and cutting elements of various sizes may be employed on the same bit.

Drag bit bodies may be cast and/or machined from metal, typically steel, or may be formed of a powder metal infiltrated with a liquid binder at high temperatures to form a matrix-type bit body. PDC cutting elements may be brazed to a matrix-type bit body after furnacing, or TSPs may even be bonded into the bit body during the furnacing process used for infiltration. Cutting elements are typically secured to cast or machined (steel body) bits by preliminary bonding to a carrier element, commonly referred to as a stud, which in turn is inserted into an aperture in the face of the bit body and mechanically or metallurgically secured thereto. Studs are also employed with matrix-type bits, as are cutting elements secured via their substrates to cylindrical carrier elements affixed to the matrix-type bit body.

It has long been recognized that PDC cutting elements, regardless of their method of attachment to drag bits, experience relatively rapid degradation in use due to the extreme temperatures and high loads, particularly impact loading, as the drag bit drills ahead downhole. One of the major observable manifestations of such degradation is the fracture or spalling of the PDC cutting element cutting edge, wherein large portions of the superabrasive PDC layer separate from the cutting element. The spalling may spread down the cutting face of the PDC cutting element, and even result in delamination of the superabrasive layer from the backing layer of substrate, or from the bit itself if no substrate is employed. At the least, cutting efficiency is reduced by cutting edge damage, which also reduces the rate of penetration of the drag bit into the formation. Even minimal fracture damage can have a negative effect on cutter life and performance. Once the sharp corner on the leading edge (taken in the direction of cutter movement) of the diamond table is chipped, the amount of damage to the table continually increases, as does the normal force required to achieve a given depth of cut. Therefore, as damage to the cutting edge and cutting face occurs and the rate of penetration of the drag bit decreases, the conventional rig-floor response of increasing weight on bit quickly leads to further degradation and ultimately catastrophic failure of the chipped cutting element.

It has been recognized in the machine-tool art that chamfering of a diamond tool tip for ultrasonic drilling or milling reduces splitting and chipping of the tool tip. J. Grandia and J. C. Marinace, "DIAMOND TOOL-TIP FOR ULTRASONIC DRILLING"; IBM Technical Disclosure Bulletin, Vol. 13, No. 11, Apr. 1971, p. 3285. Use of beveling or chamfering of diamond and cubic boron nitride compacts to alleviate the tendency toward cutter edge chipping in mining applications was also recognized in U.K. Patent Application. GB 2193740 A.

U.S. Pat. No. 4,109,737 to Bovenkerk discloses, in pertinent part, the use of pin- or stud-shaped cutting elements on drag bits, the pins including a layer of polycrystalline diamond on their free ends, the outer surface of the diamond being configured as cylinders, hemispheres or hemisphere approximations formed of frustoconical flats.

U.S. Pat. Re 32,036 to Dennis discloses the use of a beveled cutting edge on a disc-shaped, stud-mounted PDC cutting element used on a rotary drag bit.

U.S. Pat. No. 4,987,800 to Gasan et al. references the aforementioned Dennis reissue patent and offers several alternative edge treatments of PDC cutting elements, including grooves, slots and pluralities of adjacent apertures, all of which purportedly inhibit spalling of the superabrasive PDC layer beyond the boundary defined by the groove, slot or row of apertures adjacent the cutting edge.

U.S. Pat. No. 5,016,718 to Tandberg discloses the use of planar PDC cutting elements employing an axially and radially outer edge having a "visible" radius, such a feature purportedly improving the "mechanical strength" of the element.

U.S. Pat. No. 5,437,343 to Cooley et al., assigned to the assignee of the present invention and the disclosure of which is incorporated herein by reference, discloses cutting elements with diamond tables having a peripheral cutting edge defined by a multiple chamfer. Two adjacent chamfers (Cooley et al., FIG. 3) or three adjacent chamfers (Cooley et al., FIG. 5) are disclosed. The use of both two and three mutually adjacent chamfers was found to produce robust cutting edges which still afforded good drilling efficiency. It was found that a three-chamfer geometry, which more closely approximates a radius at the cutting edge than does a two-chamfer geometry, may be desirable from a durability standpoint. Unfortunately, it was also determined that grinding three chamfers takes additional time and requires precise alignment of the cutting edge and grinding tool to provide a consistent cross-sectional configuration along the cutting edge.

In summary, it has been demonstrated that if the initial chipping of the diamond table cutting edge can be eliminated, the life of a cutter can be significantly increased. Modification of the cutting edge geometry was perceived to be a promising approach to reduce chipping, but has yet to realize its full potential in conventional configurations.

BRIEF SUMMARY OF THE INVENTION

The present invention provides an improved cutting edge geometry for superabrasive cutting elements comprising multiple adjacent chamfers with an arcuate surface interposed therebetween. Such a configuration or geometry provides excellent fracture resistance combined with cutting efficiency generally comparable to conventional (straight chamfered) cutting elements and with improved durability at a given cutting efficiency.

While the present invention is disclosed herein in terms of preferred embodiments employing PDC cutting elements, it is believed to be equally applicable to other superabrasive materials such as TSPs, boron nitride, silicon nitride and diamond films.

In one currently preferred embodiment of the invention, a cutting element includes a superabrasive table having a peripheral cutting edge defined by two adjacent chamfers having an arcuate surface interposed therebetween, the two adjacent chamfers each contacting the arcuate surface in a substantially tangential relationship therewith.

In the aforementioned currently preferred embodiment, the chamfers and the arcuate surface are of at least substantially annular configuration, comprising a complete or partial annulus extending along the peripheral cutting edge.

The present invention also encompasses a method of fabricating cutting elements according to the present invention as well as drill bits carrying one or more cutting elements according to the present invention.

DETAILED DESCRIPTION OF THE INVENTION

It has been established that chamfering or beveling of the cutting edge or cutting face periphery of a planar PDC cutting element does, in fact, reduce, if not prevent, edge chipping and failure due to fracturing. It has been discovered that radiused cutter edges also greatly enhance chip resistance of the cutting edge. However, testing has confirmed that the degree of benefit derived from chamfering or radiusing the edge of the diamond table of a cutting element is extremely dependent on the dimension of the chamfer or the radius. In measuring a chamfer, the dimension is taken perpendicularly, or depthwise, from the front of the cutting face to the point where the chamfer ends. For a radiused edge, the reference dimension is the radius of curvature of the rounded edge. To provide the maximum beneficial antichipping effect, it has been established that the chamfer or the radius on the edge of the diamond table must be relatively large, on the order of 0.040–0.045 inch. However, such large chamfers significantly reduce cutting efficiency. Smaller chamfers and edge radii, on the order of 0.015–0.020 inch, are somewhat less effective in providing fracture resistance in comparison to the larger dimension chamfers and radii but do provide better cutting efficiency. Sharp-edged cutters provide maximum cutting efficiency but are extremely fragile and can be used in only the least challenging drilling applications. This deficiency of smaller chamfered and radiused edge cutting elements is particularly noticeable under repeated impacts such as those to which cutting elements are subjected in real world drilling operations.

The fact that chamfers and radii are dimensional-dependent in their anti-chipping and cutting effectiveness has dictated a delicate choice in chamfer design to find the optimum for each application. Since a single bit run typically spans a variety of formations, the requirement for durability often leads to practical compromises resulting in extremely sub-optimal cutting efficiency through much of the run. A more robust edge-finishing technology was needed to provide improved cutting efficiency without giving away cutter durability in the form of chipping and fracture. While the triple chamfer provides some of this effect, the present invention has demonstrated the superior performance of a double chamfer with an arcuate surface interposed between the two chamfers.

Figure 1:
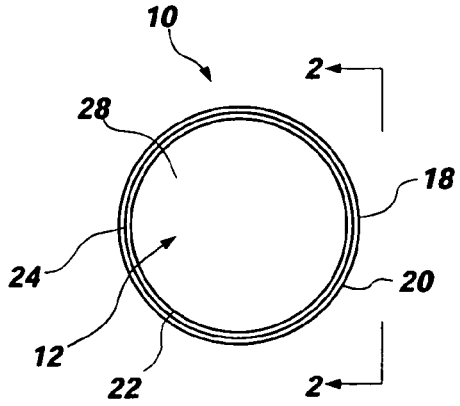
FIG. 1 is a front elevation of a round PDC cutting element according to the present invention.
Figure 2:
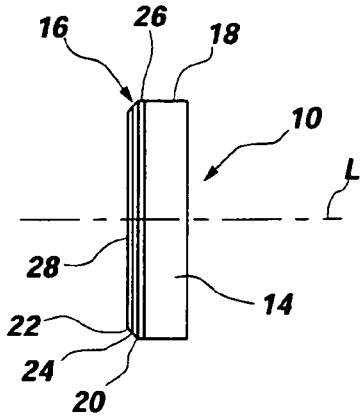
FIG. 2 is a side elevation of the cutting element of FIG. 1, taken across line 2—2.
Figure 3:
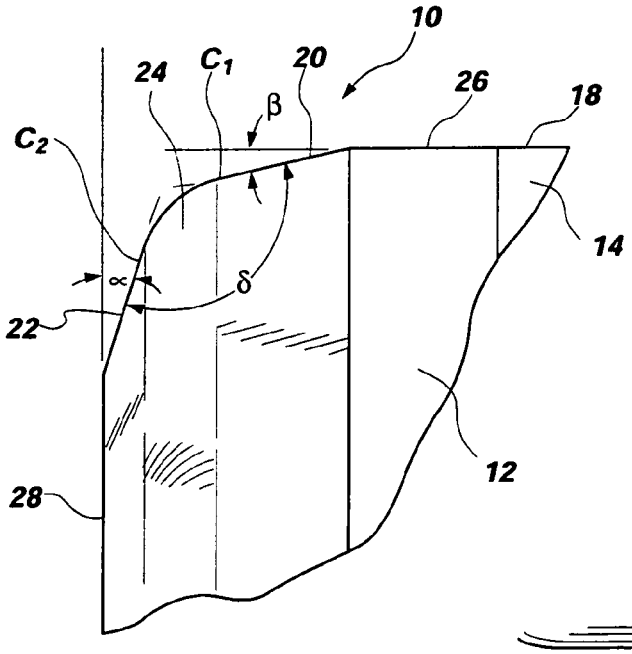
FIG. 3 is an enlarged side elevation of the outer periphery of the cutting element of FIG. 1 from the same perspective as that of FIG. 2.

Referring to FIGS. 1 through 3 of the drawings, the PDC cutting element 10 in accordance with the present invention includes a substantially planar diamond table 12, which may or may not be laminated to a tungsten carbide substrate 14 of the type previously described. The diamond table 12 may be of circular configuration as shown, may be of half-round or tombstone shape, may comprise a larger, nonsymmetrical diamond table formed from smaller components or via diamond film techniques, or may comprise other configurations known in the art or otherwise. Outer periphery 16 of diamond table 12 ("outer" indicating the edge of the cutting element which engages the formation as the bit rotates in a drilling operation) is of a double chamfer configuration, including outer chamfered surface 20 and adjacent inner chamfered surface 22 with arcuate surface 24 interposed therebetween, as may be more easily seen in FIGS. 2 and 3. If a substrate 14 is used, periphery 16 is usually contiguous with the side 18 of substrate 14, which in turn is usually perpendicular to the plane of the diamond table 12.

In the example of FIGS. 1 through 3, the outer chamfered surface 20 and inner chamfered surface 22 depart at acute angles from the orientation of the cutting element side or outer periphery 16, which (in a conventional PDC cutting element) is usually perpendicular or at 90° to the plane of diamond table 12. It is currently preferred that outer chamfered surface 20 and inner chamfered surface 22 be disposed at respective angles $\alpha$ and $\beta$ of between 5° and 15°, respectively, to the face 28 of diamond table 12 (which is perpendicular to the side 18 of substrate 14) and to a line parallel to the side 26 of diamond table 12. However, the invention is not so limited to the foregoing angles, and it should be noted that the use of diamond table faces and sides which are not mutually perpendicular (such as, for example, in the case of cutting elements having a concave or other protruding face configuration) may, of necessity, change the respective magnitudes of angles α and β. Further, in practice, the chamfered area may comprise the entire side or periphery 26 of the diamond table 12, so that no substantial unchamfered depth of diamond table remains. In such instances, angle β may be measured from a line perpendicular to the face 28 of the diamond table 12 adjacent the outer periphery 16 or, if the face is not flat, from a line parallel to a longitudinal axis L (see FIG. 2) of cutting element 10.

Another manner of characterizing the present invention may be in terms of the included angle between outer chamfered surface 20 and inner chamfered surface 22 wherein, in accordance with the present invention, an included angle δ between outer chamfered surface 20 and inner chamfered surface 22 is greater than 90°.

Arcuate surface 24, which may (as shown in FIG. 3), but need not necessarily, comprise a radius of curvature, desirably extends to respective contact points $C_1$ and $C_2$ with outer chamfered surface 20 and inner chamfered surface 22. While an exact tangential relationship may not be required, it is desirable that outer chamfered surface 20 and inner chamfered surface 22 lie as tangentially as possible to the curve of arcuate surface 24 at respective contact points $C_1$ and $C_2$. It is further desirable that at least one of the chamfered surfaces contact arcuate surface 24 tangentially. Thus, as particularly well depicted in cross-section in FIG. 3, outer chamfered surface 20 and inner chamfered surface 22 are substantially linear, while interposed arcuate surface 24 is arcuate and (by way of example) comprises a radius of curvature to which outer chamfered surface 20 and inner chamfered surface 22 are substantially tangent at respective contact points $C_1$ and $C_2$. It should be noted that arcuate surface 24 is shown as shaded in FIG. 3 and with indistinct respective boundaries with outer chamfered surface 20 and inner chamfered surface 22 as, in practice, a precisely tangential contact between arcuate surface 24 and each of the flanking outer chamfered surface 20 and inner chamfered surface 22 will not exhibit any distinct boundary and a substantially tangential contact will, in many instances, result in an equally indistinct boundary.

It is believed that stress risers at the sharp-angled periphery of a standard cutting element diamond table are at least to some degree responsible for chipping and spalling. While radiusing of the diamond table edge eliminates the angled edge, as noted previously, the large radius required for effective chip, spalling and fracture resistance is achieved at an unacceptable cost. The double chamfer with the intervening arcuate surface design depicted in FIGS. 1–3 is believed to exhibit the same resistance to impact-induced destruction as the large radius approach, apparently reducing the diamond table edge stress concentration below some threshold level.

Figure 4:
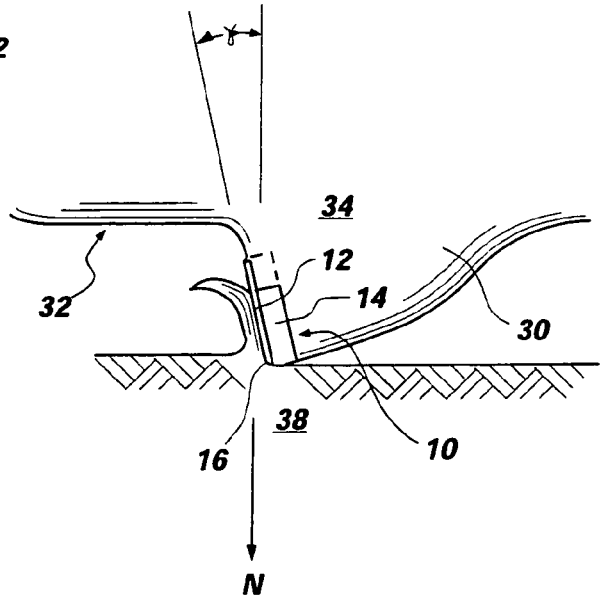
FIG. 4 is a side elevation of a PDC cutting element according to the present invention mounted on the face of a drill bit and in the process of cutting a formation.

FIG. 4 depicts a PDC cutting element 10 according to the present invention mounted on protrusion 30 of bit face 32 of a rotary drag bit 34. Drag bit 34 is disposed in a borehole so that outer periphery 16 of the diamond table 12 of PDC cutting element 10 is engaging formation 38 as bit 34 is rotated and weight is applied to the drill string to which bit 34 is affixed. It will be seen that normal forces N are oriented substantially parallel to the bit axis, and that the backraked PDC cutting element 10 is subjected to the normal forces N at an acute angle thereto. In the illustration of FIG. 4, PDC cutting element 10 is oriented at a backrake angle γ of 15° which, if PDC cutting element 10 were of conventional, sharp-edged design, would be applied to the "corner" between the front and side of the diamond table and result in an extraordinarily high and destructive force concentration due to the minimal bearing area afforded by the point or line contact of the diamond table edge. However, PDC cutting element 10 as deployed on the bit 34 of FIG. 4 may include an outer chamfer angle β of 15° as depicted in FIG. 3, substantially the same as the backrake angle γ of the PDC cutting element 10 as depicted in FIG. 4, so that the two angles β and γ effectively cooperate so that the surface of outer chamfered surface 20 provides a substantially planar bearing surface on which PDC cutting element 10 may ride. Thus, the loading per unit area is markedly decreased from the point or line contact of cutters with conventional 90° cutting edges, a particular advantage when drilling harder formations. It will be recognized that it is not necessary to orient outer chamfered surface 20 parallel to the formation, so long as it is sufficiently parallel thereto that the weight on bit and formation plasticity cause the outer chamfered surface 20 to act as a bearing surface with respect to normal forces N. Outer chamfered surface 20 effectively increases the surface of the diamond table 12 "seen" by the formation and the normal forces N, which are applied perpendicularly thereto, while the inner chamfered surface 22 at its greater angular departure from the edge of the PDC cutting element 10 provides a cutting edge which is effective at the higher depths of cut for which current drag bits are intended and which in prior art bits has proven highly destructive of new cutters.

A more sophisticated approach to matching cutter backrake and chamfer angle is also possible by utilizing "effective" backrake, which takes into account the radial position of the cutting element on the drill bit and the design rate or design range of rate of penetration to factor in the actual distance traveled by the cutter per foot of advance of the drill bit and thereby arrive at the true or effective backrake angle of a cutting element in operation. Such an exercise is relatively easy with the computational power available in present day computers, but may in fact not be necessary so long as the chamfer utilized in a bit is matched to the apparent backrake angle of a stationary bit where stud-type cutters are employed. However, where cutter pockets are cast in a matrix-type bit, such individual backrake computations and grinding of matching chamfer angles on each cutter may be employed as part of the normal manufacturing process.

Fabrication of PDC cutting elements (including TSPs) in accordance with the present invention may be easily effected through use of a diamond abrasive or electrodischarge grinding wheel, or a combination thereof, and an appropriate fixture on which to mount the cutting element and, in the case of circular or partially round elements, to rotate them past the grinding wheel. The electrodischarge grinding process lends itself particularly well to forming a radiused edge extending tangentially to two flanking chamfers, as the radiused edge may be generated without contacting either the outer diameter (side) or face surfaces of the diamond table.

While the invention has been described in terms of a planar diamond table, it should be recognized that the term "planar" contemplates and includes convex, concave and otherwise nonlinear diamond tables which nonetheless comprise a two-dimensional diamond layer which can present a cutting edge at its periphery. In addition, the invention is applicable to diamond tables of other than PDC structure, such as diamond films, as well as other superabrasive materials such as cubic boron nitride and silicon nitride.

Moreover, it must be understood that the present invention is of equal benefit to straight or linear cutting edges as well as arcuate edges such as are illustrated and described herein. Thus, while the illustrated embodiments include annular chamfers and an annular arcuate surface interposed therebetween, the invention is not so limited. Further, it is contemplated that only a portion of the periphery of a diamond table, for example, one half or even one third of the periphery, may be configured in accordance with the present invention.

Finally, it should be recognized and acknowledged that the multiple chamfer with interposed arcuate surface cutting edge of the present invention will be worn off of the diamond table as the bit progresses in the formation and a substantially linear "wear flat" forms on the cutting element. However, a significant but not exclusive intent and purpose of the present invention is to protect the new, unused diamond table against impact destruction until it has worn substantially from cutting the formation, after which point it has been demonstrated that the tendency of the diamond table to chip and spall has been markedly reduced.

In addition, while the present invention has been described in the context of use on a rotary drag bit, the term "drill bit" is intended to encompass not only full face bits but also core bits as well as other rotary drilling structures, including without limitation eccentric bits, bicenter bits, reaming apparatus (including without limitation so-called "reamer wings") and rock or tricone bits having one or more cutting elements according to the present invention mounted thereon. Accordingly, the use of the term "drill bit" herein and with specific reference to the claims contemplates and encompasses all of the foregoing, as well as additional types of rotary drilling structures.

While the cutting element, alone and in combination with a specific cooperative mounting orientation on a drill bit, has been disclosed herein in terms of certain exemplary embodiments, these are exemplary only and the invention is not so limited. It will be appreciated by those of ordinary skill in the art that many additions, deletions and modifications to the invention may be made without departing from the scope of the claims.

What is claimed is:

1. A cutting element for use on a rotary drill bit for drilling subterranean formations, comprising:

a table of superabrasive material having a face, a side and an outer periphery adjacent the face, the outer periphery as viewed from a side of the cutting element comprising at least in part:

a first surface;

a second surface adjacent the first surface and oriented at an angle of greater than about 90° to the first surface; and an arcuate surface interposed between the first surface and the second surface.

2. The cutting element of claim 1, wherein the outer periphery is nonlinear.

3. The cutting element of claim 1, wherein the cutting element includes a supporting substrate affixed to the table of superabrasive material.

4. The cutting element of claim 1, wherein the superabrasive material comprises diamond material.

5. The cutting element of claim 4, wherein the diamond material comprises a polycrystalline diamond compact.

6. The cutting element of claim 1, wherein the arcuate surface comprises, in cross-section, a radius of curvature.

7. The cutting element of claim 1, wherein at least one of the first surface and the second surface contacts the arcuate surface substantially tangentially.

8. The cutting element of claim 1, wherein each of the first surface and the second surface contacts the arcuate surface substantially tangentially.

9. The cutting element of claim 8, wherein the arcuate surface comprises, in cross-section, a radius of curvature.

10. A rotary drill bit for drilling subterranean formations, comprising:

a bit body having a shank secured thereto for affixing the bit to a drill string;

a plurality of cutting elements secured to the bit body, at least one of the cutting elements comprising:

a table of superabrasive material having a face, a side and an outer periphery adjacent the face, the outer periphery as viewed from a side of the cutting element comprising at least in part:

a first, surface;

a second surface adjacent the first surface and oriented at an angle of greater than about 90° to the first surface; and an arcuate surface interposed between the first surface and the second surface.

11. The rotary drill bit of claim 10, wherein the angle of the first surface with respect to the side is approximately the same as a backrake angle of the at least one of the cutting elements secured to the bit body of the rotary drill bit.

12. The rotary drill bit of claim 10, wherein the outer periphery is arcuate.

13. The rotary drill bit of claim 10, wherein the at least one cutting element includes a supporting substrate affixed to the table of superabrasive material opposite the face.

14. The rotary drill bit of claim 10, wherein the superabrasive material comprises a diamond material.

15. The rotary drill bit of claim 14, wherein the diamond material comprises a polycrystalline diamond compact.

16. The rotary drill bit of claim 14, wherein the arcuate surface comprises, in cross-section, a radius of curvature.

17. The rotary drill bit of claim 10, wherein at least one of the first surface and the second surface contacts the arcuate surface substantially tangentially.

18. The rotary drill bit of claim 10, wherein the at least one cutting element includes a supporting substrate affixed to the table of superabrasive material.

19. The rotary drill bit of claim 10, wherein each of the first surface and the second surface contacts the arcuate surface substantially tangentially.

20. The rotary drill bit of claim 19, wherein the arcuate surface comprises, in cross-section a radius of curvature.

21. A cutting element for use on a rotary drill bit for drilling subterranean formations, comprising:

a table of superabrasive material having an outer periphery comprising at least first and second adjacent surfaces having, as viewed from a side of the table, an arcuate surface interposed therebetween, wherein the first and second adjacent surfaces define an included angle therebetween of about 90° or greater; and wherein each of the first surface and the second surface contacts the arcuate surface substantially tangentially.

22. The cutting element of claim 21, further including a supporting substrate affixed to the table of superabrasive material.

23. The cutting element of claim 21, wherein the table of superabrasive material is affixed to a carrier element adapted to be secured to a face of the rotary drill bit.

24. The cutting element of claim 21, wherein the superabrasive material comprises a diamond material.

25. The cutting element of claim 24, wherein the diamond material comprises a polycrystalline diamond compact.

26. The cutting element of claim 21, wherein the arcuate surface comprises, in cross-section, a radius of curvature.

27. The cutting element of claim 21, wherein the arcuate surface comprises, in cross-section, a radius of curvature.

28. A rotary drill bit for drilling subterranean formations, comprising:

a bit body having a shank secured thereto for affixing the bit to a drill string;

a plurality of cutting elements secured to the bit body, at least one of the cutting elements comprising:

a table of superabrasive material having an outer periphery comprising at least first and second adjacent surfaces having, as viewed from a side of the table, an arcuate surface interposed therebetween, wherein the at least first and second adjacent surfaces define an included angle therebetween of about 90° or greater; and wherein each of the first surface and the second surface contacts the arcuate surface substantially tangentially.

29. The rotary drill bit of claim 28, further including a supporting substrate affixed to the table of superabrasive material.

30. The rotary drill bit of claim 28, wherein the table of superabrasive material is affixed to a carrier element adapted to be secured to a face of the rotary drill bit.

31. The rotary drill bit of claim 28, wherein the superabrasive material comprises a diamond material.

32. The rotary drill bit of claim 31, wherein the diamond material comprises a polycrystalline diamond compact.

33. The rotary drill bit of claim 28, wherein the arcuate surface comprises, in cross-section, a radius of curvature.

34. The rotary drill bit of claim 28, wherein the arcuate surface comprises, in cross section a radius of curvature.

* * * * *